US007486913B2

(12) United States Patent
Watanabe et al.

(10) Patent No.: US 7,486,913 B2
(45) **Date of Patent: *Feb. 3, 2009**

(54) APPARATUS AND METHOD FOR CLEANING RESIDUAL TONER FROM DRUMS IN AN IMAGE FORMING APPARATUS

(75) Inventors: Takeshi Watanabe, Kanagawa-ken (JP); Masashi Takahashi, Kanagawa-ken (JP); Minoru Yoshida, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/677,807

(22) Filed: Feb. 22, 2007

(65) Prior Publication Data

US 2007/0140734 A1 Jun. 21, 2007

Related U.S. Application Data

(62) Division of application No. 11/091,600, filed on Mar. 29, 2005, now Pat. No. 7,349,652.

(51) Int. Cl.
*G03G 15/30* (2006.01)

(52) U.S. Cl. ..... 399/149

(58) Field of Classification Search ..... 399/149, 399/71, 343, 53, 234

See application file for complete search history.

(56) References Cited

U.S. PATENT DOCUMENTS 4,727,395 A 2/1988 Oda et al.
4,763,168 A 8/1988 Lindblad
5,124,757 A 6/1992 Ikegawa
5,576,810 A 11/1996 Aita et al.
5,698,354 A 12/1997 Ugai et al.
5,740,493 A 4/1998 Otaki et al.
5,822,657 A * 10/1998 Hisada et al. ..... 399/149
6,029,033 A * 2/2000 Kawasaki ..... 399/149
6,314,251 B1 * 11/2001 Gomi et al. ..... 399/38

(Continued)

FOREIGN PATENT DOCUMENTS

JP 10-31360 A 2/1998

(Continued)

OTHER PUBLICATIONS

Takeshi Watanabe, U.S. PTO Office, U.S. Appl. No. 11/091,600, Mar. 23, 2007, 11 pages.

(Continued)

*Primary Examiner*—David M Gray
*Assistant Examiner*—Erika J. Villaluna
(74) *Attorney, Agent, or Firm*—Foley & Lardner LLP

(57) ABSTRACT

An apparatus and method for cleaning a plurality of drums in an image forming apparatus includes applying a first bias to each of a plurality of disturbing members, each disturbing member associated with a corresponding drum of a plurality of drums. While performing an image forming operation wherein at least one of the plurality of drums is not use, the bias is changed of a disturbing member corresponding to at least one of the plurality of drums not used in performing the image forming operation from the first bias to a second bias different from the first bias.

18 Claims, 3 Drawing Sheets

U.S. PATENT DOCUMENTS

| | | | | |
|---|---|---|---|---|
| 6,611,668 | B2 | 8/2003 | Watanabe et al. | |
| 6,801,375 | B2 | 10/2004 | Hayashide | |
| 6,920,300 | B2 | 7/2005 | Watanabe et al. | |
| 6,952,547 | B2 | 10/2005 | Watanabe et al. | |
| 7,349,652 | B2 * | 3/2008 | Watanabe et al. | ..... 399/149 |
| 2005/0069355 | A1 | 3/2005 | Watanabe et al. | |
| 2006/0088343 | A1 | 4/2006 | Watanabe et al. | |
| 2006/0210309 | A1 | 9/2006 | Yoshida et al. | |
| 2006/0210310 | A1 | 9/2006 | Takahashi et al. | |
| 2006/0210322 | A1 | 9/2006 | Watanabe et al. | |

FOREIGN PATENT DOCUMENTS

| | | | |
|---|---|---|---|
| JP | 2001-117424 | A | 4/2001 |
| JP | 3342217 | B2 | 8/2002 |
| JP | 2004-198957 | A | 7/2004 |

OTHER PUBLICATIONS

T. Watanabe, U.S. PTO Notice of Alowance and Fee(s) Due, U.S. Appl. No. 11/091,600, Oct. 31, 2007, 8 pages.

* cited by examiner

APPARATUS AND METHOD FOR CLEANING RESIDUAL TONER FROM DRUMS IN AN IMAGE FORMING APPARATUS

CROSS-REFERENCE TO RELATED APPLICATIONS

The present application is a division of U.S. application Ser. No. 11/091,600, filed Mar. 29, 2005, the entire contents of which are incorporated herein by reference.

FIELD OF THE INVENTION

The present invention relates generally to image forming apparatuses and, more particularly, to a system and method for cleaning residual toner from drums in an image forming apparatus.

BACKGROUND OF THE INVENTION

In a laser-type image forming apparatus, there are one or more photoelectric drums that are used in conjunction with the image formation process. If the image forming apparatus is a monochromatic or black and white (B/W) device, then there is typically only one drum used for black (K) image formation. If the image forming apparatus is color, however, there are typically four drums used, one each for black (K), cyan (C), magenta (M), and yellow (Y). During image formation, the photoelectric drum is exposed to a laser, which forms a latent image on the drum. The latent image on the surface of the drum passes by a toner source, such as a developing unit, which attracts toner to the surface of the drum to form a toner image. The toner image is then transferred to an image receiving medium, such as a paper sheet, and the transferred image is fused to the image receiving medium by a fusing unit.

To maintain proper image formation, the image forming apparatus employs a mechanism for cleaning the surface of the photoelectric drums. FIG. 1 is a diagram of a conventional "cleaner-less" drum cleaning system in an image forming apparatus. In a cleaner-less system, there is no cleaning blade or other element contacting the drum 10 to remove toner from its surface. As shown in FIG. 1, the image forming apparatus includes a drum 10, a developer 12, a transfer roller 14, a brush 16, and a charger 18. The drum 10 rotates in a clockwise direction, and the surface of the drum is charged by the charger 18. The charged surface is exposed to a laser (not shown) to generate a latent image. The latent image passes by the developer 12, which transforms the latent image into a toner image. The toner image is then transferred onto an image receiving medium by the transfer roller 14.

As shown in FIG. 1, the vast majority of the toner on the surface of the drum 10 is negatively charged toner 20, although there is some positively charged toner 22. During image formation, the image area (area exposed by the laser) typically has a −60V charge, and the non-image area typically has a −400V charge. The developer 12 is typically biased at a voltage of −250V. As the latent image passes by the developer 12, toner is transferred to the image areas. Any residual toner on the drum 10 in a non-image area is transferred to the developer 12.

As also shown in FIG. 1, the brush 16 is positioned adjacent to the surface of the drum 10. The brush 16 is given a positive voltage bias such as +600V. With the positive bias, the negative toner 20 is collected by the brush 16. However, the brush 16 is not able to collect the positive toner 22, although there are few positively charged toner particles 22. During periods between image forming operations, the bias voltage of the brush 16 can be reversed, which discharges toner from the brush 16 to the drum 10. The discharge to the drum 10 scatters the toner as a layer on the surface of the drum 10, which is then collected by the developer 12. In color image forming apparatuses, however, the toner filming is particularly severe on the color drums and cannot be effectively removed by the developer 12. As a result, the filming often results in the whitening of printed image areas as the film blocks the surface of the drum 10 from being imaged effectively.

It would be desirable to have a design that effectively cleans toner from the drums.

SUMMARY OF THE INVENTION

According to an aspect of the invention, an image forming apparatus and method for cleaning a plurality of drums in an image forming apparatus includes applying a first bias to each of a plurality of disturbing members, each disturbing member associated with a corresponding drum of a plurality of drums. While performing an image forming operation wherein at least one of the plurality of drums is not use, the bias is changed of a disturbing member corresponding to at least one of the plurality of drums not used in performing the image forming operation from the first bias to a second bias different from the first bias.

Further features, aspects and advantages of the present invention will become apparent from the detailed description of preferred embodiments that follows, when considered together with the accompanying figures of drawing.

DETAILED DESCRIPTION OF PREFERRED EMBODIMENT

Figure 1:
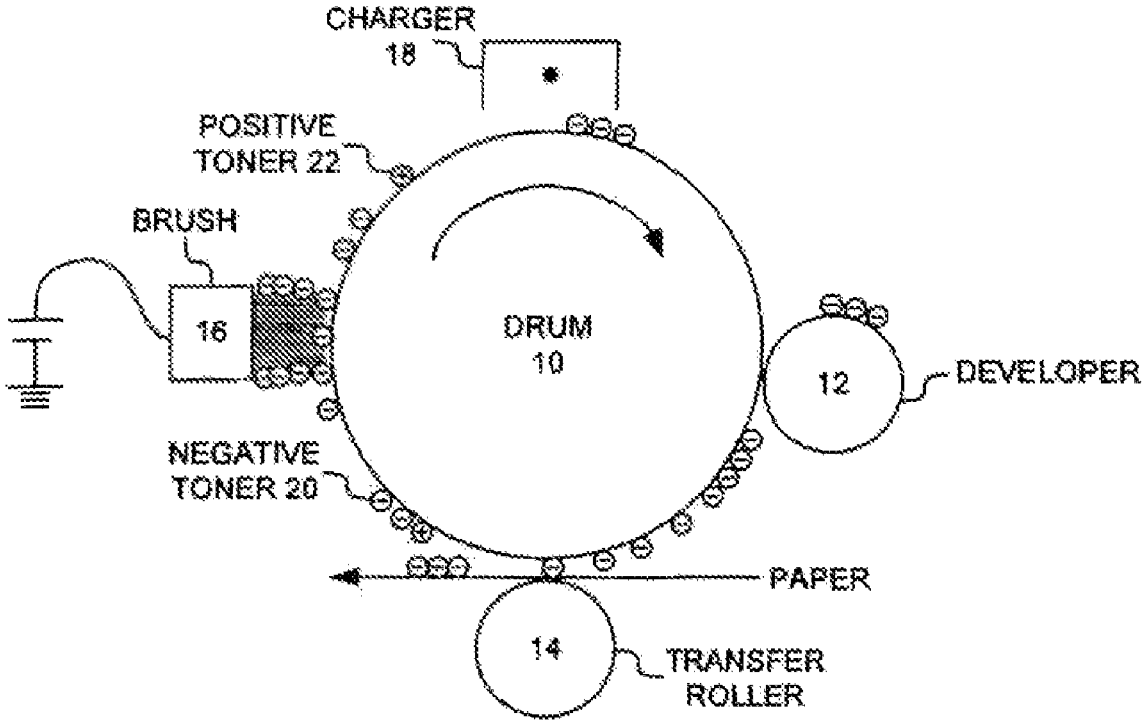
FIG. 1 PRIOR ART
FIG. 1 is a diagram of a conventional cleaner-less drum cleaning system in a image forming apparatus.
Figure 2:
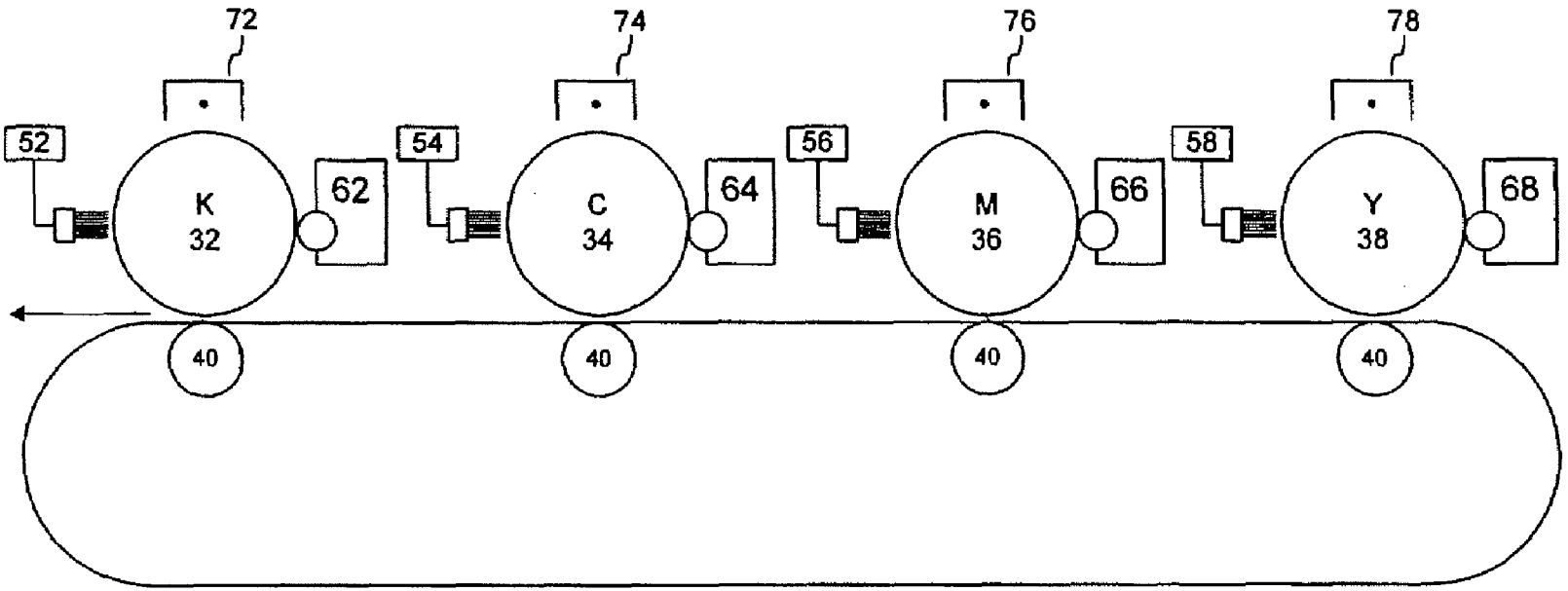
FIG. 2 is a diagram of a drum cleaning system for an image forming apparatus consistent with the present invention.

FIG. 2 is a diagram of a drum cleaning system for an image forming apparatus consistent with the present invention. The image forming apparatus can be, for example, a printer, a multi-function peripheral (MFP), a fax, a plotter, or any other device capable of generating a printout. As shown in FIG. 2, the image forming apparatus includes a black drum K 32, a cyan drum C 34, a magenta drum M 36, and a yellow drum Y 38. Each of the drums 32-38 is positioned adjacent to a respective transfer roller 40 with a transfer belt moving between the drums 32-38 and the transfer rollers 40. Each of the drums 32-38 is also positioned adjacent to a corresponding toner disturbing member, charger, and developer. In particular, the K drum 32 is positioned adjacent to a disturbing member 52, a developer 62, and a charger 72. The C drum 34 is positioned adjacent to a disturbing member 54, a developer 64, and a charger 74. The M drum 36 is positioned adjacent to a disturbing member 56, a developer 66, and a charger 76. The Y drum 38 is positioned adjacent to a disturbing member 58, a developer 68, and a charger 78.

The drums 32-38 are preferably photoelectric drums that can form a latent image in response to exposure from a laser. The toner disturbing members 52-58 may be, for example, brushes, sponge rollers, or brush rollers that can be biased at one or more potentials, such as −600V and +600V. In addition, the disturbing members 52-58 can include or be coupled to a voltage source that allows for changes in the bias setting. The change in bias setting of the disturbing members 52-58 can be made instantaneously or at a specified rate of change, such as 100V/s. The change in bias setting can be controlled by a controller of the image forming apparatus.

The developers 62-68 preferably include a developer source (i.e., source of toner in combination with carriers) and a developer roller that provides toner to the surface of the respective drums 32-38 from the developer source. The developers 62-68 are preferably set to a predetermined bias, such as −250V. In addition, the developers 62-68 are capable of collecting toner from non-image areas of the surface of the drums 32-38. An image area may have, for example, a bias of −60V, and a non-image area (i.e., area not exposed to laser light) may have, for example, a bias of −400V.

The chargers 72-78 charge the surface of the drums 32-38 to a particular bias, such as −400V. The chargers 72-78 are preferably positioned so that they are not in contact with the surface of the drums 32-38. If a toner film is formed on the drums 32-38, and the chargers 72-78 are in contact with the surface of the drums 32-38, then a toner film may form on the chargers 72-78, which can cause staining to the chargers 72-78. If stained, the ability of the chargers 72-78 to charge the surface of the drums 32-38 diminishes. To charge the surface of the drums 32-38 effectively without contacting the surface, the chargers 72-78 can be implemented as corona chargers, which are separated from the surface of the drums 32-38.

The disturbing members 52-58 are preferably positioned in contact with the photoconductor. Toner remaining on the drums 32-38 after transferring a toner image is collected by the disturbing members 52-58 to which is applied a predetermined bias voltage to attract the remaining toner. As the image forming process is repeated, the toner collected by the disturbing members 52-58 accumulates between the disturbing members 52-58 and the drums 32-38 if the bias voltage for the disturbing members 52-58 remains unchanged. In addition, the accumulated toner forms a toner film on the drums 32-38 because a predetermined mechanical pressure exists between the drums 32-38 and the disturbing members 52-58.

To prevent the toner film from forming, the bias voltage for the disturbing members 52-58 is reversed, which discharges the accumulated toner from the disturbing members 52-58 onto the drums 32-38 by electrostatic force. The discharging of the accumulated toner from the disturbing members 52-58 reduces the amount of toner adhering to the surface of the disturbing members 52-58, which substantially prevents the toner film formation. Toner filming is the phenomenon that occurs when the toner exists between the photoconductor and the disturbing member in too much or in too long time.

Figure 3:
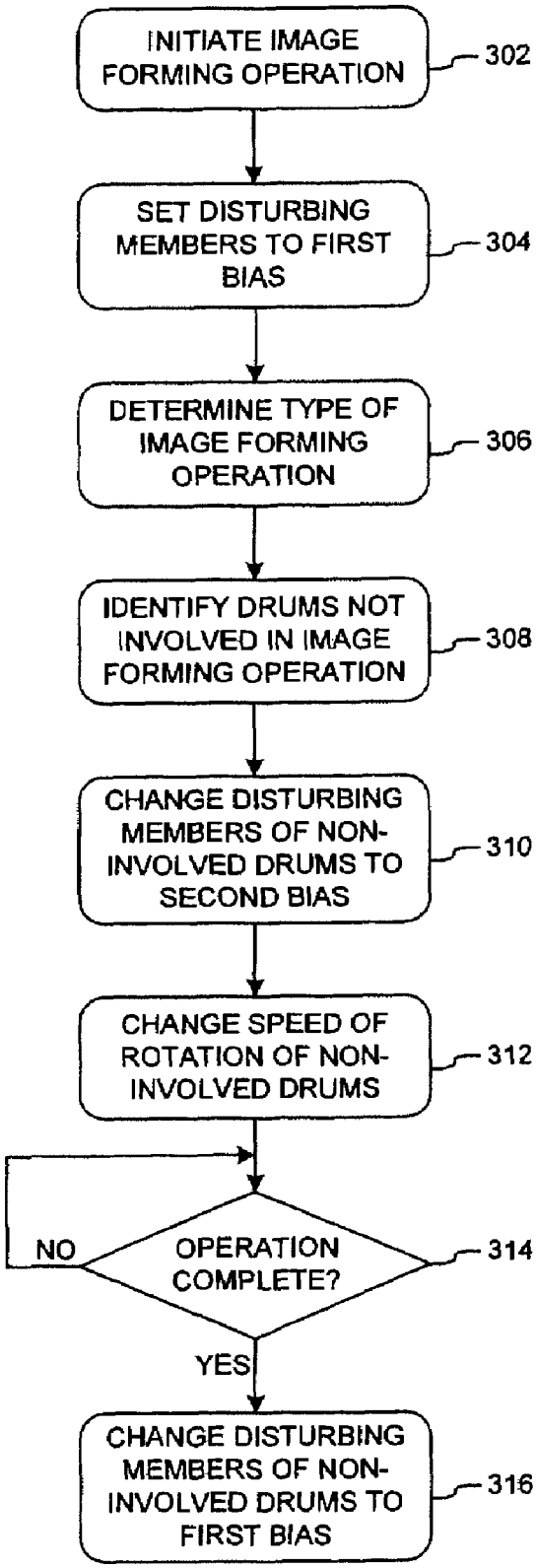
FIG. 3 is a flow diagram of a drum cleaning process for the drum cleaning system of FIG. 2 consistent with the present invention.

FIG. 3 is a flow diagram of a drum cleaning process for the drum cleaning system of FIG. 2 consistent with the present invention. This process can be implemented by a controller in the image forming apparatus. The control unit may be implemented in hardware, software, or some combination thereof. For example, the control unit may include a CPU or microprocessor and a memory, such as a ROM or NVRAM, that stores instructions executed by the CPU or microprocessor to perform the process.

As shown in FIG. 3, the process first initiates an image forming operation (step 302). The image forming operation may be, for example, a copy job, a print job, a fax job, or any other function that generates a printout. The image forming operation can be initiated at the image forming apparatus, such as through a control panel on the image forming apparatus, or in response to a signal received by the image forming apparatus via a network or other communication line, such as a print request or a received fax. The image forming operation may be for a color print, a B/W print, or a print involving some combination of or individual ones of the drums 32-38. In a color print, all of the drums 32-38 are typically used for image formation. In the B/W print, only the K drum 32 is used. In the other types of prints, such as a single color print (other than B/W), fewer than all of the drums 32-38 are used for the image formation.

In addition to initiating the image forming operation, the image forming apparatus sets the disturbing members 52-58 to a first bias (step 304). The first bias is a positively charged bias, such as +600V. The first bias is set to attract toner particles to the disturbing members 52-58. The setting to the first bias can be in response to the initiation of the image forming operation or can be a default setting.

The image forming apparatus determines the type of image forming operation being performed (step 306). As described above, the image forming operation can be for a color print, a B/W print, or a print involving some combination of or individual ones of the drums 32-38. Based on the determination, the image forming apparatus also determines which drums 32-38 are not involved in the image forming operation (step 308). For example, if it is a color print, then all of the drums 32-38 may be involved in the image forming operation. In contrast, the color drums 34-38 are not used for a B/W print, and some combination of drums 32-38 are not used for a single color print.

For any of the drums 32-38 not involved in the image forming operation, the image forming apparatus changes the bias of the corresponding disturbing member 52-58 to a second bias different from the first bias (step 310). The second bias is preferable a negatively charged bias, such as −600V. The second bias is set to cause toner particles collected at the disturbing members 52-58 to be ejected or emitted to the surface of the drums 32-38. The changing of the bias from the first bias to the second bias can be done instantaneously. However, it is preferable for the change to be made more gradually. For example, the change can be made at 100V/s or less. The more gradual change in the bias helps to even out the spread of toner on the surface of the drums 32-38, i.e., generate a more even distribution of toner on the surface of the drums 32-38. As the drums 32-38 rotate during the image forming operation, the toner on the surface of the drums is substantially removed by the corresponding developers 62-68. The removal of the toner is improved if the film is more evenly distributed on the surface of the drums 32-38.

The change in bias is preferably made to each of the disturbing members associated with the drums 32-38 not involved in the image forming operation. For example, the color drums 34, 36, 38 have their associated disturbing member 54,56,58 changed if the operation is a B/W print. However, for any situation where more than one drum 32-38 is not involved in the image forming operation, it is also possible to change the bias of only one of them or some subset of the ones not involved in the image forming operation. In addition, when more than one drum 32-38 is not involved in the image forming operation, it is possible to rotate the bias change during the image forming operation, such as changing the bias of one disturbing member for the first half of the operation, and changing the bias of another disturbing member for the second half of the operation. These periods can be broken down into one-thirds in the case of color drums 34-38 having their respective disturbing members 54-58 changed in the case of a B/W print.

In addition to changing the bias of the disturbing members 52-58 associated with the drums 32-38 not involved in the image forming operation, it is also possible to change the rotation speed of the developers 62-68 (step 312). The developers 62-68 involved in the image forming operation are typically rotating at a predetermined speed to ensure that the toner images are transferred to the image receiving medium at a proper rate. For the developers 62-68 not involved in the image forming operation, the speed of rotation can be changed from this predetermined speed to improve the removal of the toner film from the surface of the drums 32-38 by the corresponding developers 62-68. In particular, increasing the rotational speed enhances the ability of the developers 62-68 to collect unnecessary toner from the surface of the drums 32-38 because the collection of the remaining toner is performed by a mechanical and electrical force between the drums 32-38 and the developers 62-68.

The image forming apparatus checks to determine if the image forming operation is complete (step 314). If not, the bias settings of the respective disturbing members 52-58 remains the same. If the image forming operation is complete, then the bias settings of the disturbing members 52-58 set to the second bias can be returned to the first bias (step 316). Instead of the returning the bias to the first bias, it is also possible to set the bias of the disturbing members 52-58 to some default bias, such as a positive bias at a lower voltage, that saves power. Steps 302-316 can be repeated for each subsequent image forming operation.

In accordance with the present invention, it is possible to improve the removal of toner from the surface of the drums 32-38 of the image forming apparatus. When a drum 32-38 is not involved in an image forming operation, the bias of its corresponding disturbing member 52-58 is reversed so that collected toner is emitted to form a film on the surface of the drum 32-38. The bias change is preferably made so that the film is thin and substantially uniform. The speed of rotation of the developers 62-68 can be adjusted to help ensure the thinness of the toner film and to improve the removal of unwanted toner from the surface of the drums 32-38.

The foregoing description of a preferred embodiment of the invention has been presented for purposes of illustration and description. It is not intended to be exhaustive or to limit the invention to the precise form disclosed, and modifications and variations are possible in light in the above teachings or may be acquired from practice of the invention. The embodiment was chosen and described in order to explain the principles of the invention and as practical application to enable one skilled in the art to utilize the invention in various embodiments and with various modifications are suited to the particular use contemplated. It is intended that the scope of the invention be defined by the claims appended hereto and their equivalents.

What is claimed is:

1. An image forming method, comprising:

providing a plurality of drums arranged serially one behind the other along a path of movement of an image forming medium;

providing a plurality of disturbing members, each disturbing member associated with a corresponding drum of the plurality of drums;

applying a first bias to each of the disturbing members;

performing an image forming operation using at least one drum selected from the plurality of drums;

identifying at least one drum not involved in the image forming operation; and changing the bias of at least one disturbing member associated with said identified drum from the first bias to a second bias different from the first bias during the image forming operation, wherein each of the plurality of disturbing members collects toner from a surface of the corresponding drum when set to the first bias and ejects toner to the surface of the corresponding drum when set to the second bias.

2. A method according to claim 1, further comprising:

forming a toner film on a surface of the drum of which the bias of the corresponding disturbing member is changed to the second bias; and removing the toner film from the surface of the drum.

3. A method according to claim 2, wherein the step of changing the bias comprises changing the bias of a disturbing member in a color station from a first bias to a second bias during a monochromatic mode.

4. A method according to claim 2, wherein the toner film is removed from the surface of the drum by a developer adjacent to the drum.

5. A method according to claim 1, wherein the step of changing the bias includes controlling change of the bias at a predetermined rate.

6. A method according to claim 5, wherein the predetermined rate is set so that a relatively even flow of toner is emitted to the surface of the drum when the bias is changed from the first bias to the second bias.

7. A method according to claim 5, wherein the predetermined rate is about 100 V/s or less.

8. A method according to claim 1, wherein the bias of the disturbing member corresponding to a first drum is changed from the first bias to the second bias during a first portion of the image forming operation, and wherein the bias of the disturbing member corresponding to a second drum is changed from the first bias to the second bias during a second portion of the image forming operation different from the first portion.

9. A method according to claim 1, further comprising charging a surface of each of the plurality of drums with a corresponding one of a plurality of chargers positioned adjacent to the surface of the corresponding drum without contacting the drum surface.

10. A method according to claim 1, wherein the disturbing members include brushes.

11. A method according to claim 1, further comprising:

detecting the completion of the image forming operation; and changing the bias of the disturbing member set to the second bias back to the first bias in response to the detection of the completion of the image forming operation.

12. A method according to claim 1, wherein the bias of each disturbing member corresponding to at least two of the plurality of drums is changed from the first bias to the second bias one at a time during the image forming operation.

13. A method according to claim 1, wherein the bias of the disturbing member corresponding to a first drum is changed from the first bias to the second bias during a first portion of the image forming operation, and wherein the bias of the disturbing member corresponding to a second drum is changed from the first bias to the second bias during a second portion of the image forming operation different from the first portion.

14. An image forming apparatus for cleaning a plurality of drums, comprising:

a plurality of drums arranged serially in a line;

a plurality of disturbing members, each disturbing member associated with a corresponding drum of the plurality of drums; and a control unit configured to apply a first bias to each of the disturbing members, performing an image forming operation using at least one drum selected from the plurality of drums, identify at least one drum not involved in the image forming operation, and change the bias of at least one disturbing member associated with said identified drum from the first bias to a second bias different from the first bias during the image forming operation, wherein each of the plurality of disturbing members collects toner from a surface of the corresponding drum when set to the first bias and ejects toner to the surface of the corresponding drum when set to the second bias.

15. An image forming apparatus according to claim 14, further comprising:

a plurality of developers, each developer being adjacent to a corresponding drum of the plurality of drums, wherein each developer removes a toner film from the surface of the drum, the toner film being formed on a surface of the corresponding drum when the bias of the corresponding disturbing member is changed to the second bias.

16. An image forming apparatus according to claim 14, wherein the control unit is further configured to control the change of the bias at a predetermined rate.

17. An image forming apparatus according to claim 14, wherein the control unit is further configured to change the bias of the disturbing member corresponding to a first drum from the first bias to the second bias during a first portion of the image forming operation, and to change the bias of the disturbing member corresponding to a second drum from the first bias to the second bias during a second portion of the image forming operation different from the first portion.

18. An image forming apparatus according to claim 14, wherein the control unit is further configured to control the change of the bias of a disturbing member in a color station from a first bias to a second bias during a monochromatic mode.

* * * * *